US007459015B2

(12) United States Patent
Bhushan et al.

(10) Patent No.: US 7,459,015 B2
(45) Date of Patent: Dec. 2, 2008

(54) PROCESS FOR THE PREPARATION OF A CELLULOSE SOLUTION FOR SPINNING OF FIBRES, FILAMENTS OR FILMS THEREFROM

(75) Inventors: Koutu Brij Bhushan, Madhya Pradesh (IN); Salgiya Suresh Chand, Madhya Pradesh (IN)

(73) Assignee: Birla Research Institute for Applied Sciences, Madhya Pradesh (IN)

( * ) Notice: Subject to any disclaimer, the term of this patent is extended or adjusted under 35 U.S.C. 154(b) by 846 days.

(21) Appl. No.: 10/826,486

(22) Filed: Apr. 16, 2004

(65) Prior Publication Data

US 2005/0230860 A1 Oct. 20, 2005

(51) Int. Cl.
*C08L 1/02* (2006.01)

(52) U.S. Cl. ..... 106/200.2; 106/200.3

(58) Field of Classification Search ..... 106/200.2, 106/200.3

See application file for complete search history.

(56) References Cited

U.S. PATENT DOCUMENTS 3,447,939 A * 6/1969 Johnson ..... 106/124.7
3,447,956 A * 6/1969 Johnson ..... 162/158
4,246,221 A * 1/1981 McCorsley, III ..... 264/203
4,302,252 A * 11/1981 Turbak et al. ..... 106/200.3
5,094,690 A * 3/1992 Zikeli et al. ..... 106/200.2
5,888,288 A * 3/1999 Quigley et al. ..... 106/200.3
5,919,412 A * 7/1999 Firgo et al. ..... 264/187
6,153,003 A * 11/2000 Lee et al. ..... 106/200.2
6,676,739 B2 * 1/2004 Kosan et al. ..... 106/200.2

* cited by examiner

*Primary Examiner*—David M Brunsman
(74) *Attorney, Agent, or Firm*—The Webb Law Firm

(57) ABSTRACT

An improved process for the preparation of a cellulose solution for spinning of fibers, filaments or films therefrom comprising the steps of: a) activating cellulose in a mixture containing said cellulose, tertiary amine oxide solvent and, water for a period sufficient to allow a swelling of the cellulose by introduction therein of water present in said mixtures, the temperature of said activation step and concentration of solvent being such that the solvent is not converted into its monohydrate state during the step of activation; b) the cellulose, using a activator such as a glycol or a glyme, mixture being subjected to the steps of dissolution of cellulose in the solvent by heating for removal of water so as to convert the solvent into at least its monohydrate form so as to cause a dissolution.

12 Claims, 1 Drawing Sheet

PROCESS FOR THE PREPARATION OF A CELLULOSE SOLUTION FOR SPINNING OF FIBRES, FILAMENTS OR FILMS THEREFROM

BACKGROUND OF THE INVENTION

1. Field of the Invention

The present invention relates to a process for preparation of a cellulose solution for the spinning of fibres, filaments or films therefrom.

2. Description of the Related Art

The process to dissolve cellulose in tertiary amine oxide was disclosed in 1939 by Graenacher et al in U.S. Pat. No. 2,179,181. In accordance with the disclosure, the N-Oxide of trialkylamine or alkyl cycloaliphatic tertiary amine having 14 carbon atoms or less are suitable for cellulose solvent. The drawback of the process is that the solution has low cellulose content and high viscosity.

Another process to dissolve cellulose and other similar compound in tertiary amine-oxide is disclosed in U.S. Pat. No. 3,447,956 & U.S. Pat. No. 3,447,939 by Johnson et al in 1969, where a cyclic mono (N-methyl amine-N-Oxide) compound such as N-Methyl Morpholine-N-Oxide (NMMO), N-Methyl Pyro lidine N-Oxide etc. are used as solvent. This method is used to strengthen the paper or fabric strength.

In another disclosure by C. C. Mc Corsley III et al, in U.S. Pat. No. 4,142,913, a process is provided to make a solid precursor of a solution of cellulose in tertiary amine oxide. The product may be comminuted to form chips which are further fed into an extruder for shaping it into a celluosic article. The main disadvantage of this process is that the solid precursor of Cellulose & Amine oxide is highly hygroscopic and if too much water is absorbed, the phases separate. Another serious disadvantage associated with this process is that the remelting of chips for extrusion causes a severe degradation of cellulose and the remelted mass does not have proper spinning properties.

It is generally known that cellulose can be activated either by high energy radiation treatment (such as electron beam) or hydrothermal treatment or by chemical treatments. All these treatments need additional investment and also depolymerization of cellulose takes place.

An object of this invention is to propose an improved process for preparation of a cellulose solution for spinning of fibres, filaments or films therefrom.

Another object of the present invention is to provide a suitable method to dissolve cellulose in the tertiary amine oxide solution, which can directly be fed into extruder without associated the aforesaid problem.

Another objection of the invention is to provide a process which can make a cellulose-amine thermoplastic polymer having high percentage of cellulose from 7% to 28% and preferably 12%-22%.

Therefore, still another object of the present invention is to provide a simple and effective dissolution system by activating cellulose before it is dissolved in amine oxide solution.

A more specific object of the invention is to provide a process to prepare cellulose solution in amine oxide solvent which has higher cellulose content by adopting the online activation system.

A further object of the invention is to provide an improved process for making spinnable solution of cellulose and amine oxide having higher cellulose concentration and better uniformity than those described in prior arts.

A still further object of the invention is to provide a process to make a mesomorphous solution of cellulose having liquid crystal in the solution itself.

Another object of the invention is to provide a process for making cellulosic articles from cellulose amine-oxide solution which does not pollute the environment with waste product/metal ions/sulphur compounds etc. as in case of viscose process.

Yet another object of this invention is to provide a simple and online method to activate the cellulose to increase its swelling and dissolution power in aqueous amine oxide solution.

SUMMARY OF THE INVENTION

According to this invention, there is provided an improved process for the preparation of a cellulose solution for spinning of fibres, filaments or films therefrom which comprises the steps of:

i) activating cellulose in a mixture containing said cellulose, tertiary amine oxide solvent and water for a period sufficient to allow a swelling of the cellulose by introduction therein of water present in said mixtures, the temperature of said activation step and concentration of solvent being such that the solvent is not converted into its monohydrate state during the step of activation and ii) the cellulose mixture being subjected to the steps of dissolution of cellulose in the solvent by heating for removal of water so as to convert the solvent into at least its monohydrate form so as to cause a dissolution.

Further, in accordance with this invention, there is provided an improved process for making cellulose fibres, filaments or films comprising the steps of:

i) activating cellulose in a mixture containing said cellulose, tertiary amine oxide solvent and water for a period sufficient to allow a swelling of the cellulose by introduction therein of water present in said mixture, the temperature of said activation step and concentration of solvent being such that the solvent is not converted into its monohydrate state during the step of activation;

ii) the cellulose mixture being subjected to the steps of dissolution of cellulose in the solvent by heating for removal of water so as to convert the solvent into at least its monohydrate form so as to cause a dissolution;

iii) the cellulose-Amine oxide solution containing 7-28% cell, 65-80% NMMO and 5-15% water;

iv) extruding the cellulose solution as fibres, filaments or films using dry jet-wet spinning method which is stretched in air gap of 5-1000 mm develop molecular orientation;

v) regenerating the spun filaments in an aqueous spin bath containing 1-40% NMMO at temperature of 5-60 deg. C. The shaped articles are washed free of amine oxide, bleached, finished and dried.

The method used in the present invention is simple and activation takes place within the premixer or dissolving vessel. In accordance with a preferred embodiment and to facilitate dissolution of cellulose in amine oxide solution, we found that when cellulose is mixed with aqueous solution of 40-70% amine oxide containing little activator, it enhances the cellulose activation at temperature of 70-115 deg.C. It is known that the polar media like water is used for swelling the cellulose. The swelling of cellulose is enhanced at temperature above 70 deg.C in presence of amine oxide-water mixture. The activation of cellulose is complete if, at this temperature the mass is kept for 2-60 min. The cellulose dissolution is fast and good homogeneous cellulose solution is made with the treated cellulose.

The solution of the present invention can directly be fed to Spinning Section without converting them into solid chips or granules. The homogeneity of any polymer melt or solution is the key base of smooth spinning performance and final product properties. Therefore, for this invention, cellulose is activated in premixer and then the cellulose solution is made in a special mixtruder system with a facility of mixing, needing and extruding. All these operations are carried out in an aparatus which has provision of heating and evacuation. The sheet form or powder form or grounded form of cellulosic pulp (wood pulp or cotton linter) is mixed with aqueous amine-oxide solution at temperature above 70 deg.C containing small amount of activator to activate the cellulose in the premixer and fed to the mixtruder continuously, The spinnable solution has a mesomorphous phase which contains cellulose above 20% in cell amine-oxide/H2O system. Such solution has excellent spinning properties and the fibres have very high tenacity and good elongation. The solution containing cellulose above 20% preferably 25% shows anistropic properties and this gives fibres with high degree of crystalline orientation.

In accordance with this invention, cellulose is mixed with aqueous amine-oxide solution in required proportion under condition of temperature and pressure where no dissolution of cellulose takes place and only the cellulose absorbs the amine oxide uniformly. The resulting mixture is allowed to remain for sometime to activate the cellulose in presence or absence of some activator which allows the interaction of amine-oxide in cellulose fibre matrix. This results into greater swelling of cellulose. The cellulose amine-oxide mass is then sent to reactor (Mixtruder), where excess of water is removed under reduced pressure from the amine-oxide saturated cellulose at a temperature where no significant degradation of cellulose takes place and to form an extrudable/spinnable solution of cellulose. To further increase the homogeneity of solution, it is passed through a counter rotary type homogenizer. The dope is filtered and sent to Spinning Section. The metered solution is passed through a Spinnerete and spun into fibre/filaments by dry jet-wet spinning method.

In the present invention, the cellulosic raw material is any rayon grade pulp or cotton linter and amine oxide is a cyclic tertiary amine oxide preferably N-methyl morpholine N-Oxide (NMMO). Other suitable amine oxides may also be used with some changes in process parameters.

The premixing of cellulose with amine oxide and activation are carried out at temperature 70-115 deg.C. preferably 80-90 deg.C. for a period of 20-60 min. preferably 30-40 min. The concentration of amine-oxide solution is around 40 to 70% preferably 50-65%

The activation of cellulose in aqueous amine-oxide is based on the principle of intra crystalline swelling. The water present in amine-oxide solution serves as a Swelling agent. The swelling phenomenon is enhanced in presence of activator of non-ionic nature.

During the development of this invention, we studied wetting cum penetrating agents, such as the compounds of Glycols and Glymes families. These are found quite compatible with the present system. In presence of above compounds in a concentration of 0-3% by weight of cellulose the absorption capacity of aqueous 50% NMMO solution in pulp was studied. The results are shown in Table 1.

TABLE 1

ABSORPTION OF 50% NMMO SOLUTION IN PULP IN PRESENCE OF DIFFERENT NON-IONIC AGENTS

| Compound | Absorption Capcity (%) At 70 Deg. C. | At 80 Deg. C. | At 90 Deg. C. | At 100 Deg. C. | At 115 Deg. C. |
|---|---|---|---|---|---|
| Control | 159 | 160 | 160 | 160 | 160 |
| Tetra ethylene glycol 0.05% on cellulose | 161 | 163 | 165 | 167 | 168 |
| Polyethylene glycol-400 on cell (0.05% on cell) | 171 | 173 | 176 | 178 | 180 |
| Polyethylene glycol-4000 on cell (0.05%% on cell) | 191 | 195 | 199 | 202 | 208 |
| Tetra Glymes (0.05% on cell) | 160 | 165 | 166 | 166 | 167 |
| Poly Glymes (PAGE) (0.05% on cell) | 180 | 183 | 189 | 193 | 196 |

PAGE = Poly Alkylene Glycol Ether.
Above data showed the absorption of amine oxide solution in pulp under different condition of temperature with different wetting agents. Polyethylene glycols and Polyglymes increase the absorption of NMMO solution remarakably.

In activation stages actually the cellulose intramolecular structure opens up easily in presence of these activator and it absorbs more solution. Higher the absorption, higher the swelling and thereby higher the degree of activation. During our experimental trials to dissolve the cellulose in NMMO solution, we found that the polyethylene glycol (M.Wt. 400-4000) and polyglymes (specially the PAGE) increase the rate of cellulose swelling and rate of dissolution.

In searching suitable additives for getting homogenous dope, we studied the effect of some inorganic additives and we found that small amount of ammonium chloride enhances the dissolution rate and also reduces the melt viscosity. Some of our findings are reported in Table—2. The reaction time and temperature were kept constant in all cases.

TABLE 2

| Additive | Melt Viscosity (Poise) at 95 deg. C. with 15% cellulose in melt |
|---|---|
| Control | $20 \times 10^3$ |
| 0.1% NaOH on cell | $18 \times 10^3$ |
| 0.5% CaCl2 | $17.0 \times 10^3$ |
| 0.5% $NH_4Cl$ | $15 \times 10^3$ |
| 0.5% PEG 4000 | $16 \times 10^3$ |
| 0.5% PAGE | $16.5 \times 10^3$ |

When carrying out such process on a large scale, it is utmost important to operate under adequate control and safety conditions since the polymer has property to degrade very fast at elevated temperature and there is always a risk of fire if temperature of the cellulose—amine oxide solution exceeds 140 deg. C. In batch preparation, when large volume of cellulose amine oxide is to be handled, it is difficult to control the temperature and the rate of evaporation. In addition to this, due to very high viscosity of the cellulose—amine oxide solution, lot of dope retained in the dissolving vessel and thereby requires to clean the vessel before taking $2^{nd}$ batch which further causes a great loss of spinnable material and thus reducing the economy of the process.

Therefore, the further object of the invention is to provide a continuous method for producing cellulose solution and then continuously feeding the solution to spinning section to produce shaped articles like fibre, filaments or films. In accordance with the invention, this object is achieved by using a continuous processor of single or double arm mixing cum needing and extruding device in which a slurry of cellulose and amine-oxide and H2O is supplied from a premixer-cum-activator zone and the final melt of cellulose-amine oxide is discharged from the homogenizer continuously. Thus, feeding of cellulose slurry and drawing of homogenous mass of cellulose solution is carried out continuously. To avoid the degradation of cellulose during the dissolution at elevated temperature, antioxidants are used in small quantity. The preferred antioxidant is propyl gallate.

DETAILED DESCRIPTION OF THE PREFERRED EMBODIMENTS

Figure 1:
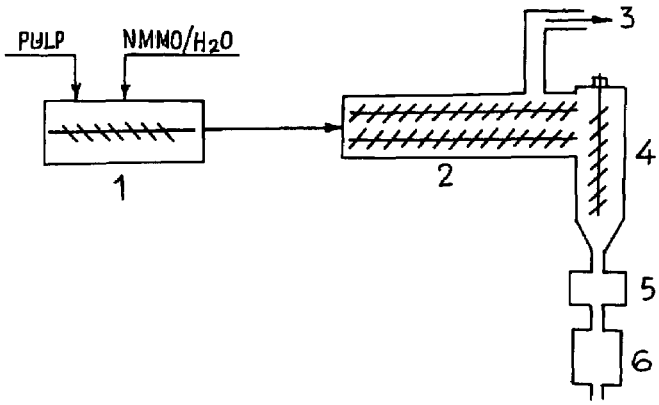
FIGS. 1 and 2 show a schematic representation of a process line to practice the present invention.
Figure 2:
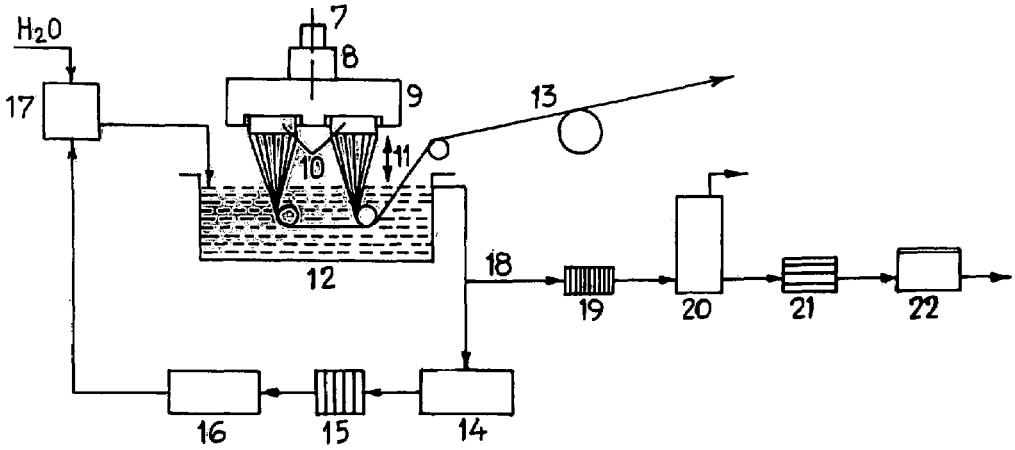

A preferred process in accordance to the present invention is carried out as described below:

A cellulosic pulp (wood pulp or cotton linter) with degree of polymerization above 800 and preferably 900-1400 is used. Referring to FIGS. 1 & 2, the slurry is made with 40-70% aqueous NMMO solution in premixer (1) where pulp is also activated with the use of some activators like glycols or glymes at temperature between 70-115° C. and preferably 80-90 deg.C. Antioxidant and Melt viscosity reducing additives are also added in the premixer. The property activated cellulose slurry is continuously fed to the processor/reactor (2) under reduced pressure at elevated temperature. The temperature range, in the Processor is usually 70-120 deg.C, and preferably 80-115 deg.C. The composition of feed slurry is adjusted as per requirement of final dope composition. In the reactor the water is removed continuously through Condenser (3) and when the water level reaches equivalent to that of monohydrade of NMMO, the cellulose gets dissolved.

With the method of present invention, cellulose solution containing 7-28% cellulose can be made. The preferred concentration of cellulose is 12-22%. The amine oxide in the solution is in the range of 65-80% and preferably 70-78%. The water content is 5-15% and preferably 6- 12%. The completeness of the dissolution is checked by monitoring the refractive index of the solution. When the refractive index reaches to a level of 1.490, it can be said that the cellulose has completely been dissolved. The dissolution completes within 40-150 mm. The dissolved mass is further made homogeneous by passing through a homogenizer system—(4). The discharge from the homogenizer, is fed into filter—(5) and passed through static mixer (6) and pumped by (7) to a metering pump (8) of spinning system. The metered amount of dope is passed through spin pack (9) and extruded through spin-nerettes—(10) having a 50-250 micron hole dia using dry jet-wet spinning technique. The air gap (11) between the jet surface and spin bath is usually from 5 mm to 1000 mm and preferably 50 mm to 250 mm. The spin bath (12) comprises of aqueous NMMO solution containing 1-40% NMMO preferably 5-25% and temperature 5-60 deg.C. preferably 20-30 deg.C. The take up speed of the filaments (13) are 30-400 m/mm and preferably 50-150 m/mm. The filaments are further washed to remove NMMO solution from the tow by a countercurrent washing method and then bleached, finished and dried. To impart crimp, the tow is passed through a stuffer box and then cut into staple (not shown in FIG. 2). The used spin bath is collected in tank—(14) which is filtered through (15) and purified (16) spin bath is collected on top tank (17). The fibre properties of the invention have been tested and listed in various examples.

The stream—(18) of excess spent spin bath is sent to recovery section, where it is filtered at (19) and excess of water is removed in distillation column—(20). Further, it is purified by ion exchange resin (21) and pure NMMO solution of 40-60% is obtained at (22), which is circulated in the process.

The invention will further explain in even more detail way by means of following examples which are given for illustration and are not to be taken as, in any way, limiting the invention.

EXAMPLE 1

A cellulose solutions is prepared by mixing 345 gm of ketchikan K-120 pulp containing 7% water in 5000 g of 50% NMMO/water solution. The pulp and NMMO/H2O mixture is fed in the premixer and mixing is carried out for 60 min at 80° C. 0.2% propyl gallate (antioxidant) and 0.5% PEG 400 on the basis of cellulose weight are also added. During this period, the pulp absorbs the water present in aqueous NMMO solution and gets activated which facilitates the penetration of NMMO in the interior of fibre matrics. The slurry is then fed into reactor under vacuum where temperature is maintained to 90° C. The water is removed through condenser, and 2140 g of water is allowed to remove. At this stage, the complete dissolution of cellulose takes place and it shows the refractive index of 1.490. The melt (i.e. cell NMMO/H2O solution) so obtained has 10% cellulose 12% water and 78% NMMO. This solution is passed through homogenizer, filtered and sent to spinning machine through static mixer.

The metered amount of solution is passed through a spinnerettes having 13 holes and 200 micron hole diameter with L/D ratio 1:1. The filaments are allowed to travel in the air for a distance of 15 cm and then passed through a spin both containing 5% aqueous NMMO at 20° C. The filaments are taken on godet at 60 m/min speed and washed counter currently by water to remove the amine-oxide completely. It is further bleached, finished dried and passed through a stuffer box to impart crimps and then cut into staples. The fibre properties are shown in table—3.

TABLE 3

| | | |
|---|---|---|
| Denior | | 2.7 |
| Cond. Tenacity | gpd | 4.01 |
| Wet Tenacity | gpd | 2.8 |
| Cond. Elong. | % | 12.5 |
| Wet Elong. | % | 13.6 |
| Wet Mod. at 5% elong. | gpd | 1.25 |

EXAMPLE 2 to 5

The cellulose solution is prepared as described in example—1 except that the different activatorsae used in the premixer during mixing to enhance the activation of cellulose. The polymer (cellulose solution) characteristics are reported in Table—4.

TABLE 4

POLYMER CHARACTERISTICS

| | | Example | | | |
|---|---|---|---|---|---|
| | | 2 | 3 | 4 | 5 |
| | | Parameters | | | |
| | Unit | Without activation | Activation without catalysis | Activation with 0.5% PEG 4000 on cell | Activation with 0.5% PAGE on cell |
| Activation | Min | — | 60 | 60 | 60 |
| Cell | % | 10.1 | 10.0 | 10.2 | 10.1 |
| NMMO | % | 77.9 | 78.0 | 78.0 | 78.0 |
| Water | % | 12.0 | 12.0 | 11.8 | 11.9 |
| Dissol. Temp | deg. C. | 90 | 90 | 85 | 85 |
| Diss. Time | Min | 150 | 110 | 90 | 95 |
| Melt Viscosity At 95 deg. C. | (Poise) | 7 × 103 | 6.4 × 103 | $6.0 \times 10^3$ | $6.2 \times 10^3$ |
| Cellulose | DP | 480 | 550 | 680 | 650 |

The spinning of solution is carried out as per example 1 using 5% NMMO in spin bath & 15 cm as air gap. Fibres are washed, bleached, finished & dried. Fibre properties are shown in Table—5.

TABLE 5

| | | Example | | | |
|---|---|---|---|---|---|
| | | 2 | 3 | 4 | 5 |
| Cond. Tenacity | gpd | 3.9 | 4.0 | 4.1 | 4.0 |
| Wet | | 2.7 | 2.76 | 2.90 | 2.80 |
| Cond. Elong | % | 10.1 | 10.3 | 11.7 | 11.2 |
| Wet | % | 12.1 | 12.5 | 13.0 | 12.6 |
| Wet Modulus At 5% elong. | gpd | 1.20 | 1.28 | 1.33 | 1.31 |

EXAMPLE 6 TO 8

Cellulose solution is made by activating the K-120 pulp with PEG 4000 (0.5%) on cell for 30 min in premixer and then fed into the reactor where excess of water is removed. The dissolution is completed in 85 min at 85 deg.C. The solution of different cellulose concentrations are made. The quantities of pulp and NMMO taken and water to be removed are shown in Table 6. The solution so obtained is spun in a single screw extruder using spinnerette of 200 micron hole dia by dry jet-wet spinning method. Air gap is kept 15 cm and spin bath composition is 5% Aqueous NMMO at 20 deg.C with spinning speed of 75 m/min. The fibres are washed, bleached finished and dried. The results are shown in Table 6.

TABLE 6

POLYMER COMPOSITION AND FIBRE PROPERTIES

| | | Example | | |
|---|---|---|---|---|
| | | 6 | 7 | 8 |
| Feed Composition: | | | | |
| Pulp containing 7% moisture | gm | 539 | 664 | 845 |
| Wt. of 50% NMMO solution | gms | 5000 | 5000 | 5000 |
| Water to be removed | gms | 2206 | 2239 | 2274 |
| Final melt wt. | gms | 3333 | 3425 | 3571 |

TABLE 6-continued

POLYMER COMPOSITION AND FIBRE PROPERTIES

| | | Example | | |
|---|---|---|---|---|
| | | 6 | 7 | 8 |
| Polymer Composition: | | | | |
| Cell | % | 15.0 | 18.0 | 22.0 |
| NMMO | % | 75.0 | 73.0 | 71.0 |
| Water | % | 10.0 | 9.0 | 7.0 |
| Cellulose | DP | 650 | 600 | 590 |
| Fibre Prioperties: | | | | |
| Cond. Tenacity | gpd | 4.0 | 4.3 | 4.6 |
| Wet Tenacity | gpd | 2.6 | 2.9 | 3.0 |
| Cond. Elongation | % | 11.5 | 10.8 | 10.5 |
| Wet Elongation | % | 12.5 | 12.3 | 12.0 |

EXAMPLE 9 & 10

Cellulose solution is prepared as described in Example 6. The cellulose is activated in premixer at 80 deg. C. for 30 min. using PEG 4000 (0.3% on cell basis) in both the examples, In example 10, we have used 0.5% Ammonium-Chloride (on cell) in the premixer to facilitate dissolution and to reduce melt viscosity. The solution is spun as described in example 1 and the results are reported in Table—7.

TABLE 7

POLYMER CHARACTERISTICS AND FIBRE PROPERTIES

| | | Example | |
|---|---|---|---|
| | | 9 | 10 |
| Activator | | PEG 4000 | PEG 4000 |
| Additives | | — | NH4C1 |
| Polymer Composition: | | | |
| Cell | % | 15.0 | 15.1 |
| NMMO | % | 74.8 | 75.2 |
| Water | % | 10.2 | 9.7 |
| Melt Viscosity Poise | | $10.0 \times 10^3$ | $14.5 \times 10^3$ |
| Film DP | DP | 625 | 620 |
| Fibre Properties: | | | |
| Denier | | 1.70 | 1.72 |
| Cond. Tenacity | gpd | 4.1 | 4.5 |
| Wet Tenacity | gpd | 2.8 | 3.1 |
| Cond. Elongation | % | 10.3 | 11.2 |
| Wet Elongation | % | 12.5 | 13.3 |
| Wet Modulus at 5% elong. | gpd | 1.31 | 1.35 |

We claim:

1. An improved process for the preparation of a cellulose solution for spinning of fibres, filaments or films there from comprising in the steps of:

i) activating cellulose in a mixture containing said cellulose, tertiary amine oxide solvent, activator and water for a period sufficient to allow a swelling of the cellulose by introduction therein of water present in said mixtures, to obtain activated cellulose, the temperature of said activation step and concentration of solvent being such that the solvent is not converted into its monohydrate state during the step of activation;

ii) the activated cellulose being subjected to the steps of dissolution of cellulose in the solvent by heating under reduced pressure for removal of water so as to convert the solvent into at least its monohydrate form so as to cause a dissolution.

2. A process as claimed in claim 1, wherein an activator is added to said mixture, said activator selected from Glycols and Glymes.

3. A process as claimed in claim 1, wherein said amine oxide is N-Methyl Morpholine N-Oxide (NMMO).

4. A process as claimed in claim 1, wherein said cellulose is selected from rayon pulp and cotton linter pulp.

5. A process as claimed in claim 1, wherein said solvent is a mixture of about 40% to about 70% NMMO by weight and about 30% to about 60% water by weight.

6. A process as claimed in claim 1, wherein the step of activation is carried out for a period of 20-60 minutes.

7. A process as claimed in claim 1, wherein the temperature of said activation step is maintained in the range of 70°-115° C.

8. A process as claimed in claim 7, wherein the step of dissolution of the activated cellulose is carried out under reduced pressure.

9. A process as claimed in claim 1, wherein the step of dissolution comprises heating the activated cellulose at a temperature of 70° to 120° C.

10. A process as claimed in claim 1, wherein the step of dissolution is carried out for 40 to 150 minutes.

11. A process as claimed in claim 1, wherein said activator is present in an amount of 0.05% to 3.0% by weight of the cellulose.

12. A process as claimed in claim 1, wherein a said cellulose solution contains from about 7% to about 28% by weight dry cellulose, from about 65% to about 80% by weight tertiary amine oxide and from 5% to 15% by weight water.

* * * * *